US007160103B2

(12) United States Patent
Butler et al.

(10) Patent No.: US 7,160,103 B2
(45) Date of Patent: Jan. 9, 2007

(54) METHOD AND APPARATUS FOR MODIFYING THE PATH OF A FLAME

(75) Inventors: Gary Lee Butler, Silver Lake, MN (US); Chad William Hendrickson, Prior Lake, MN (US); Robb Edward Bennett, Prior Lake, MN (US); Stephen G. Smith, Lakeville, MN (US); Thomas J. Bachinski, Lakeville, MN (US); David Charles Lyons, Red Wing, MN (US)

(73) Assignee: HNI Technologies Inc., Muscatine, IA (US)

( * ) Notice: Subject to any disclaimer, the term of this patent is extended or adjusted under 35 U.S.C. 154(b) by 72 days.

(21) Appl. No.: 10/803,181

(22) Filed: Mar. 16, 2004

(65) Prior Publication Data

US 2005/0208444 A1 Sep. 22, 2005

(51) Int. Cl.
*F23Q 2/32* (2006.01)
*F24B 1/181* (2006.01)

(52) U.S. Cl. ..... 431/125; 126/519

(58) Field of Classification Search ..... 431/125; 126/519, 521, 524

See application file for complete search history.

(56) References Cited

U.S. PATENT DOCUMENTS 1,734,669 A 11/1929 Frisch
3,499,432 A * 3/1970 Hannebaum ..... 126/519
3,685,946 A 8/1972 Adams
4,786,247 A 11/1988 Bhattacharjee
5,678,534 A * 10/1997 Fleming ..... 126/512
6,019,099 A 2/2000 Shimek et al.
6,550,687 B1 4/2003 Lyons et al.
6,729,551 B1 5/2004 Lyons et al.
2002/0166554 A1 10/2002 Berg
2004/0261780 A1* 12/2004 Frink et al. ..... 126/92 B

FOREIGN PATENT DOCUMENTS

GB 387751 9/1931
GB 2293875 8/1994
JP 59097416 6/1984

OTHER PUBLICATIONS

U.S. Appl. No. 10/339,739, filed Jan. 8, 2003; entitled Heat Exchange System; Lyons et al.; 15 pages.
U.S. Appl. No. 10/718,037, filed Nov. 19, 2003; entitled Backlighting System for a Fireplace.
U.S. Appl. No. 10/769,557, filed Jan. 20, 2004; entitled Exhaust System for Open Front Fireplace.

* cited by examiner

*Primary Examiner*—Alfred Basichas
(74) *Attorney, Agent, or Firm*—Faegre & Benson LLP

(57) ABSTRACT

An apparatus and method for modifying the appearance of a flame to maximize the size of the flame for a given amount of fuel, increase a burn rate efficiency of the flame, or change the shape of the flame. The shape and size of the flame may be modified by applying a secondary source of fluid to the flame. The secondary source of fluid may cause turbulent fluid flow within the combustion chamber enclosure in which the flame is produced to change the appearance of the flame. The secondary source of fluid may be generated by a blower or fan and may include, for example, a source of fresh combustion air, additional flammable gas such as natural gas, or other fluid additives for enhancement of the flame color, shape, and size.

21 Claims, 10 Drawing Sheets

METHOD AND APPARATUS FOR MODIFYING THE PATH OF A FLAME

BACKGROUND OF THE INVENTION

1. Field of the Invention

The present invention generally relates to generating flames from a flammable material, and more particularly relates an apparatus and method for modifying the appearance of a flame, namely the shape and size of a flame.

2. Related Art

Flame generating devices typically burn a combustible fuel to produce a flame with a certain appearance. The appearance of a flame includes at least the size, shape, and color of the flame. A flame appearance may be affected by, for example, the type of fuel being burned, the ratio of fuel and primary combustion air, environmental conditions such as humidity and oxygen concentration, fuel additives, and the size and shape of the fuel burner. When producing a flame for heating purposes only, the appearance of the flame may be less important. However, when a flame is provided primarily for aesthetic purposes or provided for both aesthetic and heating purposes, the flame appearance may be more important.

SUMMARY OF THE INVENTION

The present invention generally relates to decorative fire display devices, such as a decorative fireplace, that combust a combustible fuel to produce a flame. The present invention more particularly relates to an apparatus and method for modifying the appearance of a flame for the purpose of, for example, maximizing the size of a flame for a given amount of fuel, increasing a burn rate efficiency of the flame, or changing the shape of the flame.

One aspect of the invention relates to a fire display device that includes a burner configured to burn a combustible fuel to produce a flame, a combustion chamber enclosure being configured to enclose the flame, and a source of moving fluid directed toward the flame from an upstream or downstream position relative to a path of the flame. The moving fluid is adapted to change the flame path thereby altering an appearance of the flame. The fire display device may further include a first transparent cylindrical combustion chamber and the flame and source of moving air engage each other in the cylinder to change the appearance of the flame. The fire display device may further include a second transparent cylinder combustion chamber that encloses the first combustion chamber to provide a heat barrier between the first and second combustion chambers while providing a substantially unobstructed view of the flame.

Another aspect of the invention relates to a method of altering the path of a flame provided in a combustion chamber enclosure. The method includes producing a flame in the combustion chamber enclosure and engaging the flame with a directed source of fluid provided from an upstream or downstream position relative to a path of the flame. The directed source of fluid is adapted to alter the flame path thereby changing an appearance of the flame. The directed source of fluid may also increase the bum rate efficiency of the flame and reduce a temperature of the combustion chamber enclosure.

A still further aspect of the invention relates to a fireplace assembly that includes a combustion chamber enclosure that defines a combustion chamber, a fuel source configured to provide a flame in the combustion chamber from a combustible fuel, and a fluid moving means that is separate from the fuel source and is configured for moving fluid in the combustion chamber. The fluid from the fluid moving means may increase a burn rate efficiency of the fuel and alter an appearance of the flame.

The above summary of the present invention is not intended to describe each disclosed embodiment or every implementation of the present invention. Figures in the detailed description that follow more particularly exemplified embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments in the invention and in connection with accompanying drawings, in which.

Figure 5:
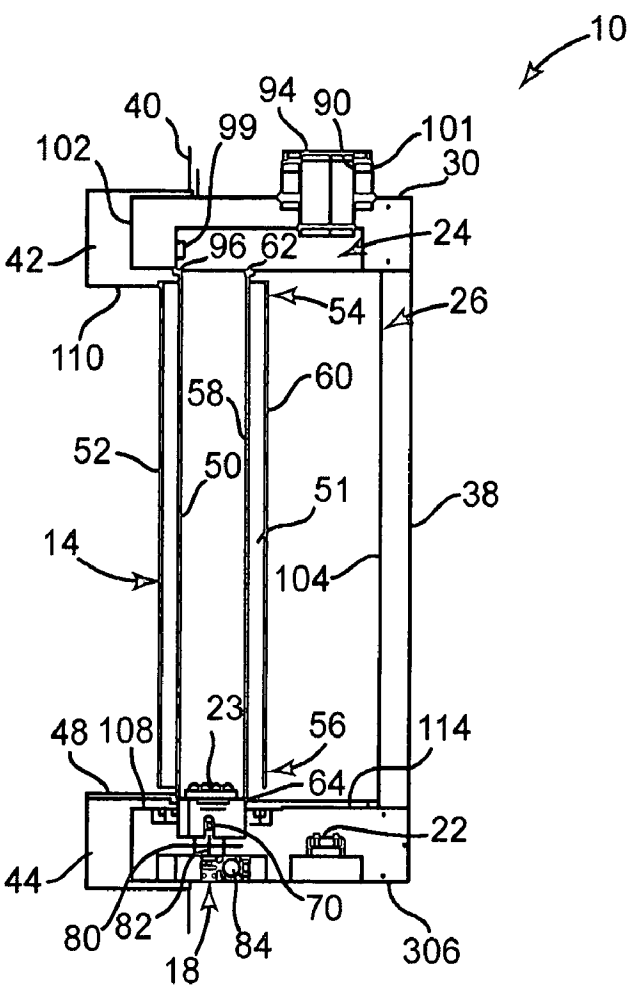
FIG. 5 is a cross-sectional side view of the fireplace assembly shown in FIG. 1 taken along cross-sectional indicators 5—5.
Figure 1:
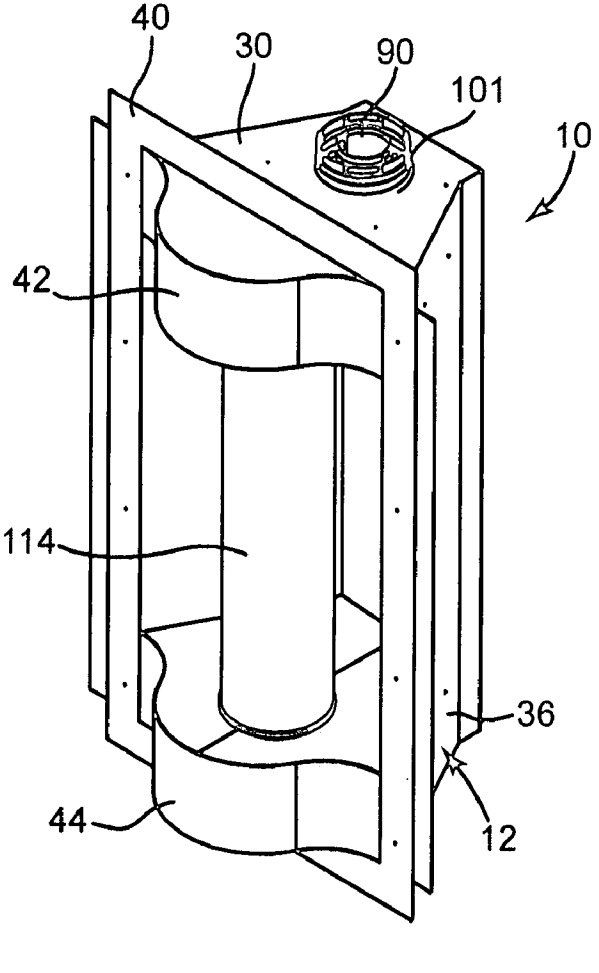
FIG. 1 is a front perspective view of an example fireplace assembly according to principles of the present invention.
Figure 4:
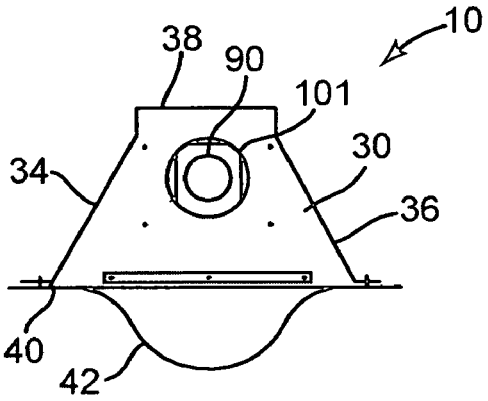
FIG. 4 is a top view of the fireplace assembly shown in FIG. 1.
Figure 2:
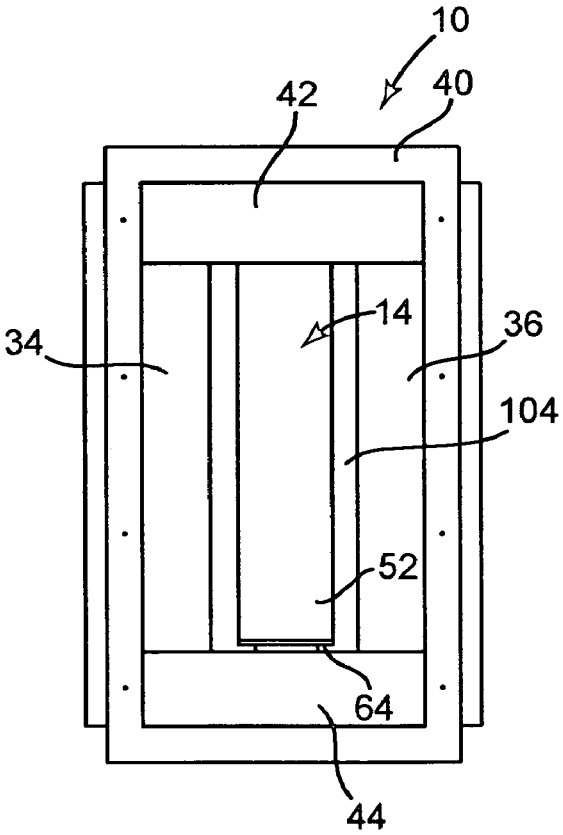
FIG. 2 is a front view of the fireplace assembly shown in FIG. 1.
Figure 3:
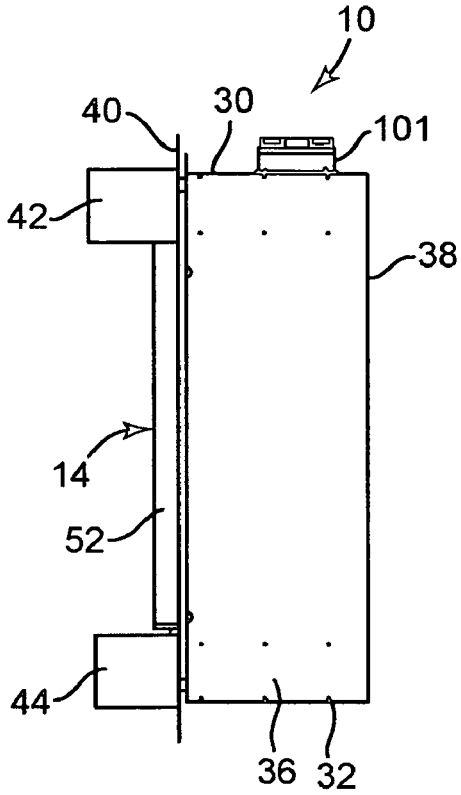
FIG. 3 is a side view of the fireplace assembly shown in FIG. 1.

While the invention is amenable to various modifications and alternate forms, specifics thereof have been shown by way of example in the drawings and will be described in detail. It should be understood, however, that the invention is not limited to the particular embodiments described. On the contrary, the invention is to cover all modifications, equivalents, and alternatives falling within the spirit and scope of the invention.

DETAILED DESCRIPTION OF THE PREFERRED EMBODIMENT

The present invention generally relates to decorative fire display devices such as fireplaces that combust a combustible fuel to produce a flame. One aspect of the present invention relates to an apparatus and method for modifying the appearance of a flame for the purpose of, for example, maximizing the size of the flame for a given amount of fuel, increasing a burn rate efficiency of the flame, or changing the shape of the flame. The shape and size of the flame may be modified by applying a secondary source of fluid at an upstream or downstream position relative to a path of the flame. In an embodiment wherein the flame is produced within a combustion chamber enclosure, the secondary source of fluid may cause turbulent fluid flow within the combustion chamber enclosure that affects the appearance of the flame. The secondary source of fluid applied to the flame may be generated by a blower or fan and may include, for example, a source of fresh combustion air, additional flammable gas such as natural gas, or other fluid additives for enhancement of the flame color, shape or size.

As used herein, the phrase "combustion chamber enclosure" may include any enclosure in which flames and/or heat are generated or simulated. The term "viewing surface" is any surface through which at least a portion of an interior of the combustion chamber enclosure may be viewed. For example, a viewing surface may consist of a pane of translucent, tempered, or ceramic glass or high temperature plastic positioned to cover at least a portion of an opening into the combustion chamber enclosure. A "heat generating appliance" is defined as any appliance or apparatus that includes a combustion chamber enclosure and is configured to provide both a source of heat and an aesthetic function. A "fluid" as used herein is defined as any liquid or gas, and includes at least air, combustible gases, and scent and coloring additives. The term "air" may be used interchangeably with the term "fluid" throughout this documents and is not intended to have a specific content of gaseous elements.

Referring now to FIGS. 1–6, an example decorative fire display device 10 is shown and described. Display device 10 includes an outer housing 12, a combustion chamber enclosure 14, a burner assembly 16, a secondary air assembly 18, a valve 20, controls 22, an exhaust vent assembly 24, and a fresh air assembly 26. The valve 20 and controls 22 regulate production of a flame at the burner assembly 16 to produce a flame within the combustion chamber enclosure 14. The fresh air assembly 26 provides fresh combustion air to the valve 20 and controls 22 for use as a primary source of combustion air that is mixed with the combustible fuel and fed to the burner assembly 16. The fresh air assembly 26 also provides air for the secondary air assembly 18 for altering the appearance of the flame after it is produced at the burner assembly 16.

The outer housing 12 includes top and bottom panels 30, 32, first and second side panels 34, 36, a rear panel 38, and a front panel 40. The outer housing 12 also includes top and bottom curved facade members 42, 44, and first and second floor panels 46, 48. The top and bottom curved facade members 42, 44 are designed to substantially match the curvature of the combustion chamber enclosure 14, but may have different shapes in other embodiments. The panels 30, 32, 34, 36, 38, 40 of the outer housing 12 may be sized differently in different embodiments for different applications and installment configurations. For example, the outer housing 12 may define a substantially portable unit with the appropriate heat safety ratings, venting capabilities, and protective materials to provide a robust, safe and portable device. In other embodiments, the outer enclosure may include quick release features that allow the display device 10 to be easily removed from one installation point at a first location and reinstalled at a different location, for example, being moved from within a living structure to a patio or other outside living area. In still further embodiments, (for example, see display device 600 shown in FIG. 18) the outer enclosure 12 may define in part the combustion chamber enclosure of the display device rather than a separate combustion chamber enclosure being required, as with display device 10.

The combustion chamber enclosure 14 of display device 10 includes first and second transparent cylindrical members 50, 52 that are defined by a cylindrical side wall 58, 60 having first and second ends 54, 56. A top connecting vent member 62 and a bottom connecting vent member 64 provide positive attachment between the combustion chamber enclosure 14 and other features of display device 10, and further provide the necessary fluid ventilation for the combustion chamber enclosure 14. The first and second cylindrical members 50, 52 are radially spaced apart so as to provide an insulating chamber 51 (see FIG. 5) that provides a thermal barrier between the first and second cylindrical members 50, 52. The insulating chamber 51 may be filled with air or some other transparent or translucent fluid and is preferably open at one or more ends 54, 56 of the combustion chamber enclosure 14 so that the heated fluid within the chamber 51 can exit the chamber thereby increasing the insulating effect. Display device 10 includes top and bottom connecting vent members 62, 64 that each include a plurality of apertures to facilitate air flow through the chamber 51 using, for example, forced air provided by the secondary air assembly 18.

The first and second cylindrical members 50, 52 may be made from glass, plexi-glass, or some other transparent or translucent heat resistant material that provides visualization of at least a portion of a flame provided within the combustion chamber enclosure 14. In some embodiments, the second cylindrical member 52 may be replaced with a different sized and shaped transparent member that extends along, for example, the front panel 40 of the outer housing 12. In still further embodiments, only a single cylindrical member or no transparent cylindrical member at all may be used depending on such considerations as safety and the desired flame appearance, as well as other aesthetic and functional features for a given display device.

Figure 6:
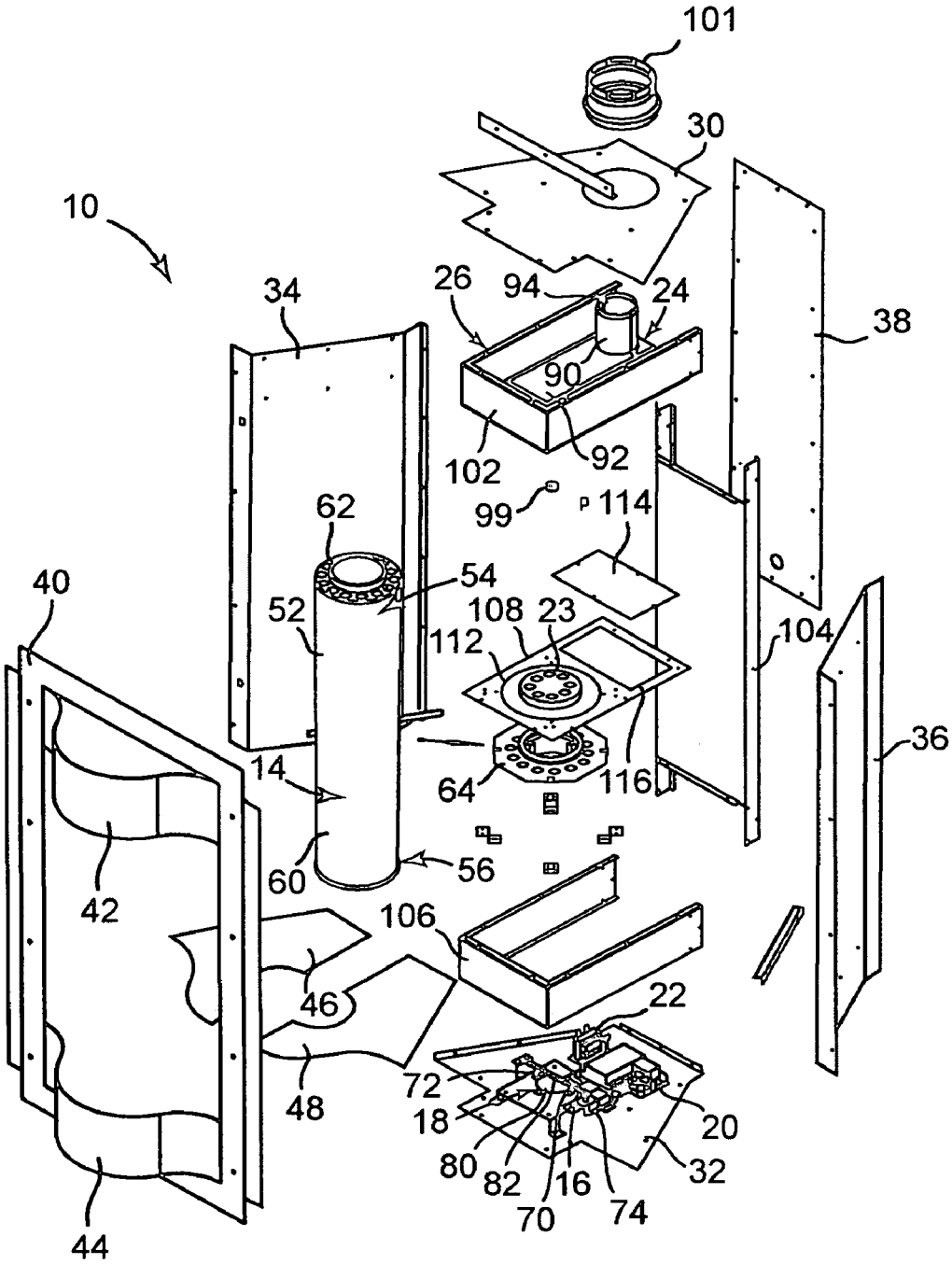
FIG. 6 is an exploded front perspective view of the fireplace assembly shown in FIG. 1.
Figure 11:
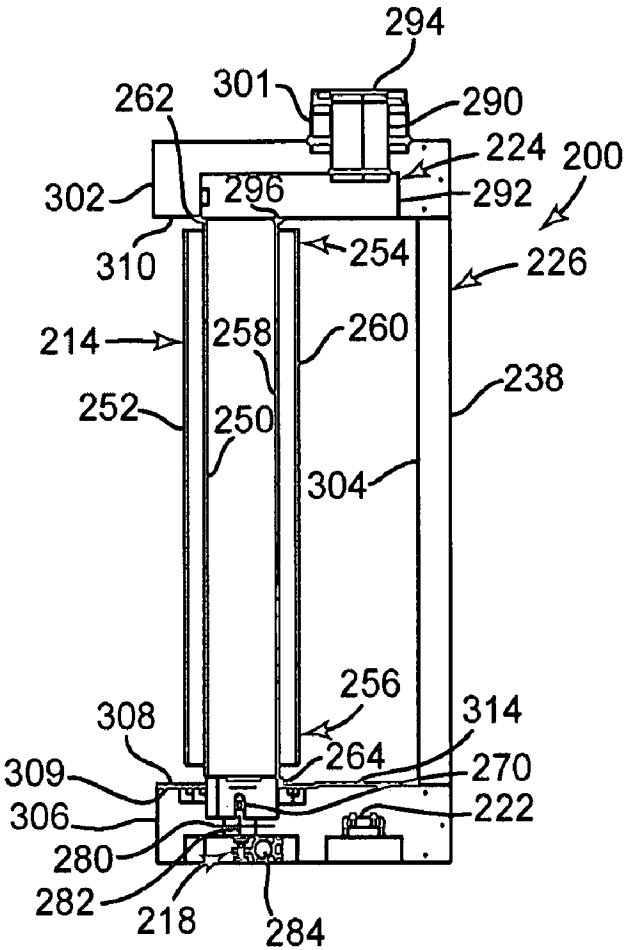
FIG. 11 is a cross-sectional side view of the fireplace assembly shown in FIG. 1 taken along cross-sectional indicators 11—11.
Figure 7:
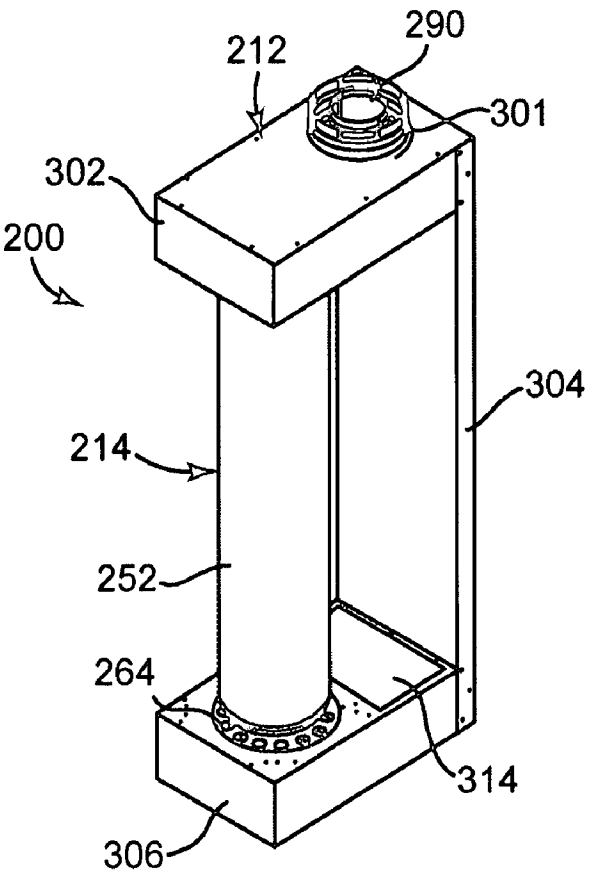
FIG. 7 is a front perspective view of another example fireplace assembly according to principles of the present invention.
Figure 10:
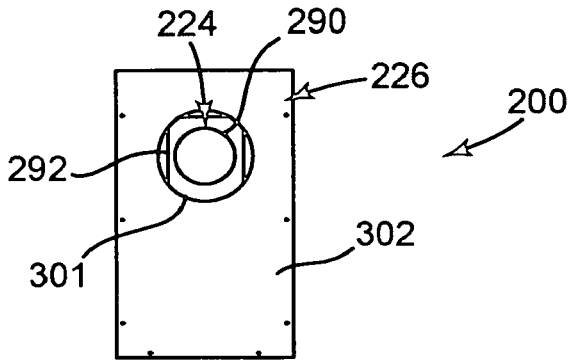
FIG. 10 is a top view of the fireplace assembly shown in FIG. 7.
Figure 8:
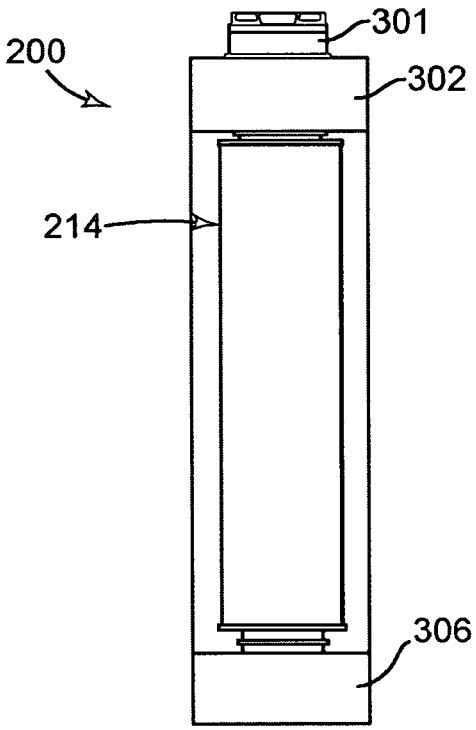
FIG. 8 is a front view of the fireplace assembly shown in FIG. 7.
Figure 9:
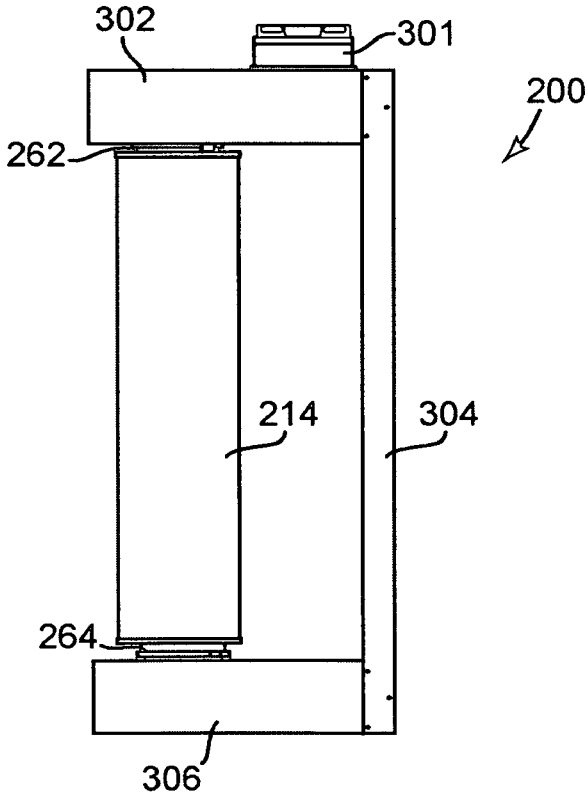
FIG. 9 is a side view of the fireplace assembly shown in FIG. 7.
Figure 12:
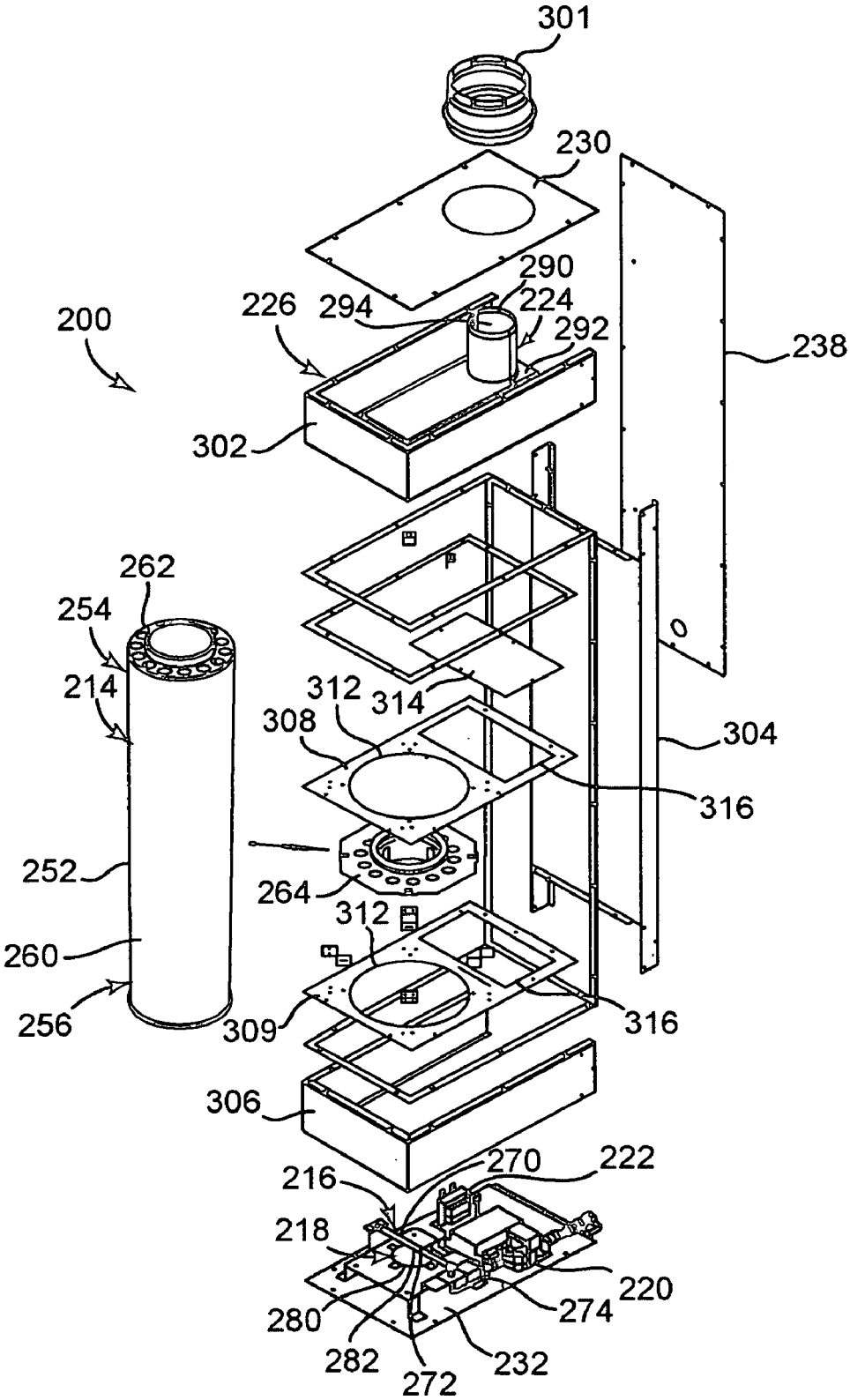
FIG. 12 is an exploded front perspective view of the fireplace assembly shown in FIG. 7.
Figure 13:
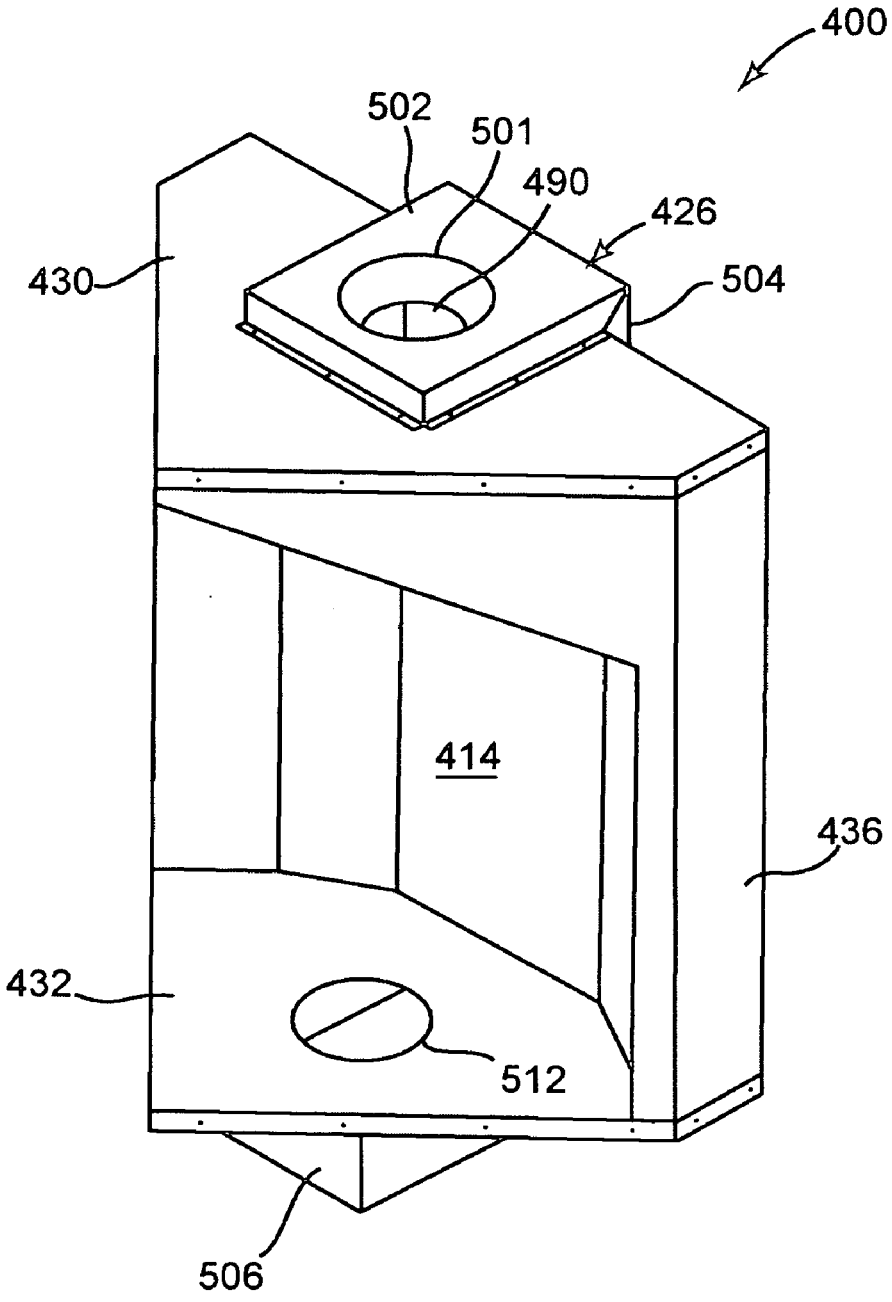
FIG. 13 is a front perspective view of an example fireplace housing assembly according to principles of the present invention.
Figure 16:
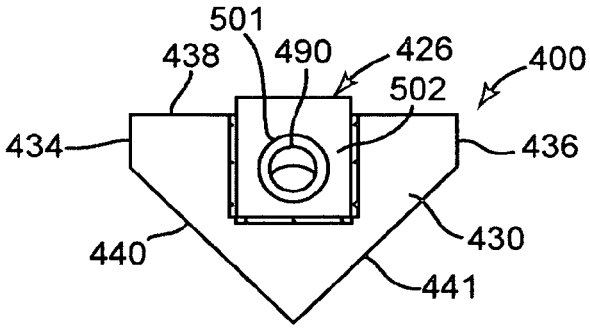
FIG. 16 is a top view of the fireplace housing assembly shown in FIG. 13.
Figure 14:
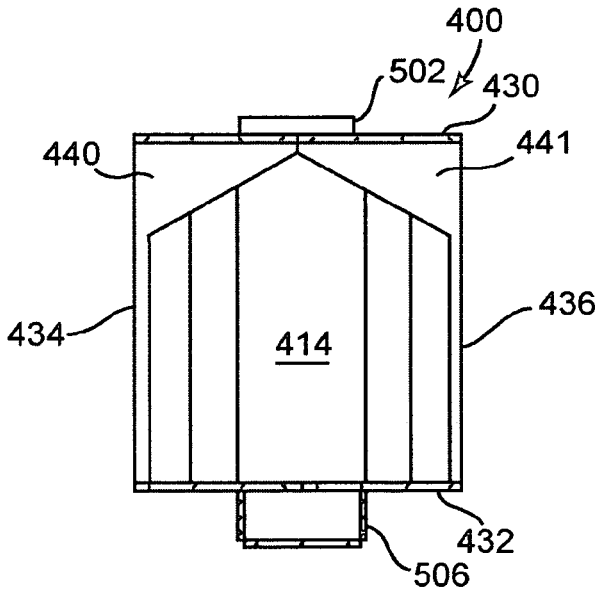
FIG. 14 is a front view of the fireplace housing assembly shown in FIG. 13.
Figure 15:
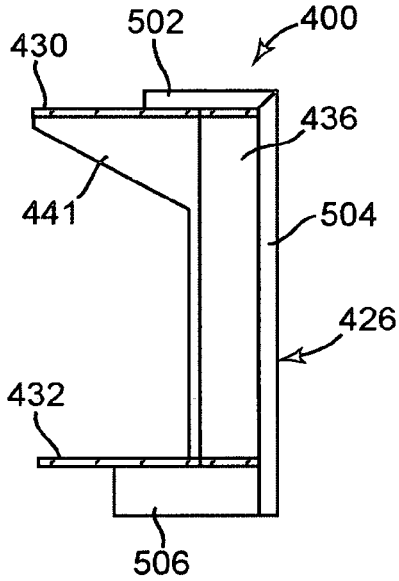
FIG. 15 is a side view of the fireplace housing assembly shown in FIG. 13.
Figure 17:
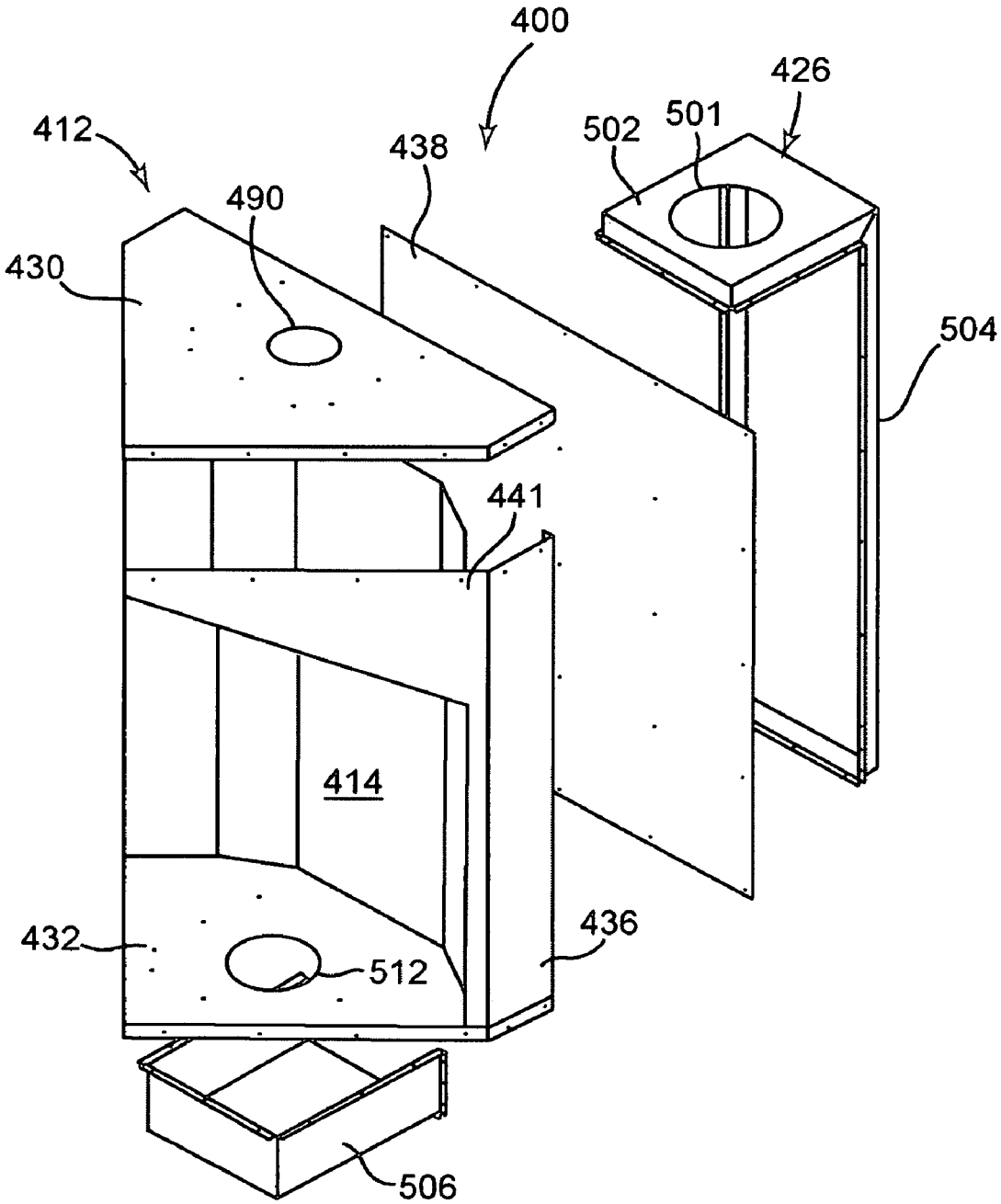
FIG. 17 is an exploded front perspective view of the fireplace housing assembly shown in FIG. 13.

Referring to FIGS. 5 and 6, the burner assembly 16 includes a tubular burner member 70 having at least one orifice 72 for generation of a flame at the orifice. The tubular member 70 is filled with a fuel or fuel/air mixture provided by the fuel line 74, which is coupled to the valve 20. The valve 20 and controls 22 control mixing of the fuel with a source of primary combustion air that is then fed to the orifice 72 and ignited via an ignition system (not shown) that is also controlled by controls 22. The burner assembly 16 may also include an ember bed 23 positioned generally adjacent to the burner member 70 that gives the appearance of a bed of burning embers. The ember bed 23 may be illuminated when engaged by flames produced by the burner assembly 70, or may be independently illuminated using, for example, electrically resistive element. Example electric ember devices for use with a fireplace are shown and described in U.S. Published Patent Application No. Publication No. US2002/0166554A1, filed on May 9, 2001 and entitled ELECTRIC EMBER BED, which patent application is incorporated herein by reference in its entirety.

The secondary air assembly 18 includes a rotating blade 80 that rotates about a vertical axis 82 and is powered by a motor 84. The blade 80 is positioned below the second end 56 of the combustion chamber enclosure 14 and directs fluid into the first cylindrical member 50. In some embodiments, the secondary air assembly 18 may also direct fluid into the chamber 51 defined by the second cylindrical member 52. Moving fluid provided by the secondary air assembly 18 engages the flame produced at the burner tubular member 70 resulting in a change in the appearance of the flame.

The exhaust vent assembly 24 includes an exhaust outlet duct 90, an exhaust housing 92, an exhaust outlet 94, and an exhaust inlet 96. The exhaust vent assembly 24 is in fluid communication with the combustion chamber enclosure 14 and is configured to provide an exhaust outlet for combustion gases and heat produced by the burner assembly 16. The exhaust vent assembly 24 is preferably positioned at a location vertically above the combustion chamber enclosure so that the natural convection of heated gases and air within the combustion chamber enclosure 14 flow out of the vent assembly 24.

The fresh air assembly 26 includes an inlet duct collar 101, an inlet chamber 102, a rear chamber 104, a bottom chamber 106, and a cover 108. The inlet chamber 102 includes a bottom panel 110 that includes an aperture (not shown) that provides fluid communication between the combustion chamber enclosure 14 and the exhaust vent assembly housing 92. The inlet duct collar 101 is also coupled to the inlet chamber 102 at a top surface thereof, wherein the top surface may be defined by the top panel 30 of the outer housing 12. The rear chamber 104 extends along a rear side of the outer housing 12 and provides fluid communication between the inlet chamber 102 and the bottom chamber 106. The bottom chamber 106 is sized to house the burner assembly 16, the secondary air assembly 18, the valve 20 and the controls 22.

The arrangement of the inlet duct collar 101 and the exhaust outlet duct 90 of respective assemblies 26, 24 are advantageous for a direct vent venting assembly in which the exhaust and fresh combustion air ducts extend coaxial with each other. A coaxial venting arrangement saves space and provides cooling of the exhaust duct as the exhaust duct passes through a living structure. In other embodiments (not shown) the venting and fresh air ducts may extend co-lineal with each other. In ether the coaxial or co-lineal arrangements, the venting ducts may be coupled to the display device 10 at different locations other than the top panel 30, such as, for example, at the rear panel 38 or the first and second side panels 34, 36.

In some embodiments, the exhaust outlet duct 90 may be coupled to a heat recovery system that removes heat from the combustion gases and heated air and transfers that heat back into a living space of the living structure via a central heating system or other ducting configuration. An example heat recovery system is shown and described in U.S. Pat. No. 6,550,687, U.S. patent application Ser. No. 10/339,739 filed on Jan. 8, 2003 and entitled HEAT EXCHANGE SYSTEM, and U.S. patent application Ser. No. 10/371,761 filed on Feb. 24, 2003 and entitled FIREPLACE MAKEUP AIR HEAT EXCHANGE SYSTEM, which issued patent and patent applications are incorporated herein by reference in their entirety. The heated fresh air produced by display device 10 may be directed to various places within the structure as disclosed in U.S. Pat. No. 6,019,099, which patent is also incorporated herein by reference in its entirety.

In other embodiments, a source of light may be included in the display device 10 and directed into the combustion chamber enclosure 14 or onto various exposed surfaces of the outer housing 12. Example backlighting systems for a display device are shown and described in U.S. patent application Ser. No. 10/718,037, which application was filed on Nov. 19, 2003 and entitled BACKLIGHTING SYSTEM FOR A FIREPLACE, which patent application is incorporated herein by reference in its entirety. Such a source of light may be positioned within one of the fresh air assembly chambers 102, 104, 106, the exhaust housing 92 of the exhaust vent assembly 24, or possibly within features of the outer housing 12 such as within a space defined by the top and bottom curved facade members 42, 44. A source of light may be used whether or not a flame is present and may provide different colors for different possible display "moods".

Display device 10 may also include a heat safety device 99 that is capable of monitoring temperatures associated with device 10. Safety device 99 may be positioned within the exhaust vent assembly 24 or at other locations in or around device 10 at a location wherein a desired temperature can be monitored. Temperatures of the device 10 can be used to determine whether the device is too hot for a given application and may be capable of generating a temperature signal that is used by controls 22 to control the amount of fuel provided to the burner assembly 16. A similar temperature sensor is disclosed in U.S. application Ser. No. 10/769,557, filed on Jan. 30, 2004 and entitled EXHAUST SYSTEM FOR OPEN FRONT FIREPLACE, which application is incorporated herein by reference in its entirety.

Referring now to FIGS. 7–12, another example decorative fire display device 20 is shown and described. Display device 200 includes an outer housing 212, a combustion chamber enclosure 214, a burner assembly 216, a secondary air assembly 218, a valve 220, controls 222, and exhaust vent assembly 224, and a fresh air assembly 226. The display device 200 has many of the same or similar features as display device 10, but does not include many of the features of outer housing 12. The display device 200 may be compatible with a variety of different housing configurations for mounting inside or outside of a wall structure at locations within or outside of a living structure.

Outer housing 212 includes a top panel 230, a bottom panel 232, and a rear panel 238 that are coupled to respective chambers 302, 304, 306 of the fresh air assembly 226. The fresh air assembly 226 also includes an inlet duct collar 301, a bottom panel 310 coupled to the inlet chamber 302, first and second cover members 308, 309 that define a combustion chamber enclosure opening 312, and an access opening 316. An access panel 314 covers the access opening 316, and the opening 312 provides fluid communication between the bottom chamber 306 and the combustion chamber enclosure 214.

The combination of panels of the outer housing 212 and the chambers 302, 304, 306 of the fresh air assembly 226 provide fresh combustion air to the secondary air assembly 218, and the valve 220 and controls 222 use some of the fresh air as a source of primary combustion air for mixing with combustible gas that is provided to the burner assembly 216.

The combustion chamber enclosure 214 includes first and second transparent cylindrical members 250, 252 having first and second ends 254, 256 and cylindrical sidewalls 258, 260. Top and bottom connecting vent members 262, 264 couple the first and second cylindrical members to the exhaust vent assembly 224 and the bottom chamber 306, respectively. The vent members 262, 264 each include a plurality of apertures that provide fluid communication to an insulating chamber 251 defined by a spacing between the first and second cylindrical members 250, 252. The insulating chamber 251 may be sealed closed or may be open for the free flow of an insulating fluid to help reduce the temperature of the second cylindrical member 252 relative to the temperature of the first cylindrical member 250.

The burner assembly 216 includes a tubular member 270 having an orifice 272. A source of mixed fuel and air is provided at the orifice 272 via a fuel line 274, whereby a flame is produced at the orifice 272. The controls 222 and valve 220 control the flow of the fuel air mixture to the orifice 272 and further control ignition of the flame. Heat and combustion gases produced as a result of combusting the fuel at the orifice 272 is vented through the exhaust inlet 296, exhaust housing 292, and an exhaust outlet 294 defined by an exhaust outlet duct 290 of the exhaust vent assembly 224.

The secondary air assembly 218 includes a blade member 280 mounted via a vertical axis 282 to a motor 284 that rotates the blade. Rotation of the blade 280 provides moving fluid into at least the first cylindrical member 250 and possibly into the chamber 251 in some embodiments. The secondary air assembly 218 is positioned vertically below the orifice 272 of the burner assembly 216 such that moving air provided by the secondary air assembly 218 engages the flame produced by the burner assembly 216 to change the appearance of the flame. In other embodiments (for example, see FIG. 18) the secondary air assembly is positioned vertically above the flame, for example within the exhaust vent assembly 224, to move secondary fluid away from or towards the flame to change an appearance of the flame.

Referring now to FIGS. 13–17, another example decorative fire display device 400 is shown and described. Display device 400 includes an outer housing 412 that defines a combustion chamber enclosure 414, and a fresh air assembly 426. The outer enclosure 412 includes top and bottom panels 430, 432, first and second side panels 434, 436, a rear panel 438, and first and second front panels 440, 441. Display device 400 may include first and second substantially flat transparent members (not shown) that are coupled to the first and second front panels 440, 441 in place of or in addition to a transparent cylindrical member as included in devices 12, 212.

The display device 400 includes an exhaust outlet duct 490 and a fresh air assembly 426 that includes an inlet duct collar 501, an inlet chamber 502, a rear chamber 504, a bottom chamber 506, and a combustion chamber enclosure opening 512. Although not shown, the display device 400 may also include a burner assembly, a valve, a secondary air assembly, and controls that provide a flame within the combustion chamber enclosure, and further features adapted and configured to modify the appearance of the flame.

Figure 18:
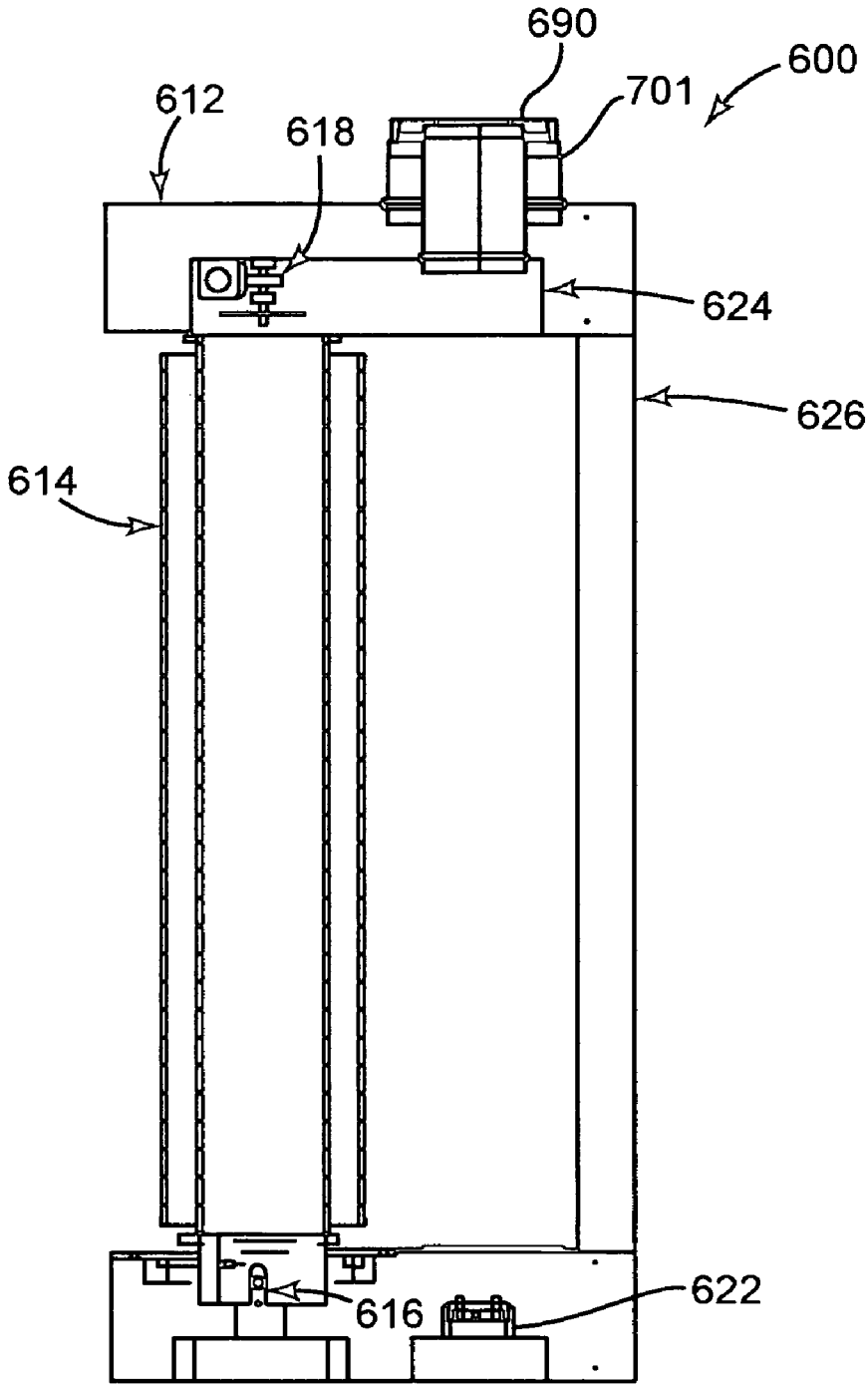
FIG. 18 is a cross-sectional side view of another example of a fireplace assembly according to principles of the present invention.

Referring now to FIG. 18, another example decorative fire display device 600 is shown including an outer housing 612, a combustion chamber enclosure 614, a secondary air assembly 618, a burner assembly 616, an exhaust vent assembly 624, a fresh air assembly 626, and controls 622. The secondary air assembly 618 is positioned vertically above the combustion chamber enclosure 614 so as to move air either into or out of the combustion chamber enclosure and assist in venting combustion gases and heated air through the exhaust duct 690 and out of the display device 600. The fresh air assembly 626 may be coupled via the inlet duct collar 701 to a source of fresh combustion air for use as a primary source of combustion air that is mixed with fuel provided to the burner 616, and for use as a source of secondary air to modify the appearance of the flame.

In all of the examples above, the use of a secondary source of air applied to the flame may, in addition to altering an appearance of the flame, improve the burn rate efficiency of the combusting fuel. Such increased burn rate efficiency may substantially eliminate carbon deposits and other combustion by-products within the combustion chamber enclosure, and significantly reduce emissions from the display device.

The use of a secondary source of air applied to the flame may also have the advantage of cooling at least some features of the combustion chamber enclosure of the display device by engaging features of the combustion chamber enclosure with the moving secondary air.

Although the examples described above and shown in the figures are directed primarily to positioning a secondary air assembly either vertically above or below the flame, other embodiments may include secondary air assemblies positioned at other locations in the display device relative to the flame, such as, for example, from sides or from diagonally oriented positions relative to the flame. In addition, although the above described examples provide combustion chamber enclosures that are substantially sealed relative to an exterior surface of the display device, other embodiments may include open combustion chamber enclosures that include sufficient additional venting necessary to prevent unwanted combustion by-products from exiting into a living space adjacent to the display device while still providing the desired modification of the flame appearance.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A fire display device, comprising:

a fresh air assembly providing a primary and a secondary air stream;

a burner assembly configured to premix the primary air stream with a combustible fluid and comprising a burner configured to produce a flame having a flame path;

a combustion chamber enclosure configured to enclose the flame; and a secondary air assembly configured to change the flame path by directing the secondary air stream towards the flame; the secondary air assembly including a rotating blade positioned below the combustion chamber, the blade adapted to rotate with sufficient speed to cause a turbulent air flow that enhances the size and shape of the flame within the combustion chamber, and wherein the secondary air assembly produces a rotating flame.

2. The fire display device of claim 1, wherein the combustion chamber enclosure is configured as a glass cylinder.

3. The fire display device of claim 1, wherein the secondary air assembly comprises compressed fluid.

4. The fire display device of claim 1, further comprising an ignition system configured to ignite the flame after the secondary air assembly is operational.

5. The fire display device of claim 1, wherein the secondary air assembly is configured to increase a burn efficiency of the flame.

6. The fire display device of claim 1, further comprising a light source configured to direct light into the combustion chamber.

7. The fire display device of claim 1 further comprising an artificial ember configured to give the appearance of a burning ember, the artificial ember being positioned adjacent to the burner.

8. The fire display device of claim 1, further comprising a heat safety device that includes a heat sensor and a combustion control member, wherein when a predetermined temperature is sensed in the combustion chamber enclosure by the heat sensor the combustion control member reduces combustion of the combustible fuel.

9. The fire display device of claim 1, wherein the combustion chamber includes a generally vertically oriented cylindrical member, and the flame is injected into the cylindrical member at a vertically lower end of the cylinder.

10. The fire display device of claim 1, wherein the combustion chamber enclosure includes first and second ends and a continuous, substantially transparent sidewall extending between the first and second ends.

11. The fire display device of claim 1, wherein the fire display device is a fireplace.

12. The fire display device of claim 1, wherein the secondary air assembly is configured to modulate the secondary air stream.

13. A method of altering the path of a flame, the method comprising the steps of:

providing a primary and a secondary air stream;

premixing the primary air stream with a combustible fluid before being ignited;

producing a flame in a burner assembly the flame having a flame path enclosed in a combustion chamber enclosure; and altering the flame path by directing the secondary air stream towards the flame, wherein the secondary air stream is directed by rotating a blade positioned below the combustion chamber about a vertical axis at a sufficient rate to create a turbulent air flow that enhances the size and shape of the flame, and wherein the secondary air assembly produces a rotating flame.

14. The method of claim 13, wherein the secondary air stream is compressed air.

15. The method of claim 13, further comprising the step of modulating the secondary air stream.

16. The method of claim 13, further comprising the step of modulating the combustible fluid.

17. The method of claim 13, further comprising the step of directing the secondary air stream to increase a burn efficiency of the flame.

18. The method of claim 13, further comprising the step of directing the secondary air stream to substantially increase the size of the flame.

19. The method of claim 13, further comprising the step of directing the secondary air stream to substantially reduce a temperature of at least a portion of the combustion chamber enclosure.

20. The method of claim 13, further comprising the step of rotating the secondary air stream.

21. The method of claim 13, further comprising the step of pulsing the secondary air stream.

* * * * *